US007510346B2

(12) United States Patent
Riker

(10) Patent No.: US 7,510,346 B2
(45) Date of Patent: Mar. 31, 2009

(54) SIGNPOST FORMED OF RECYCLED MATERIAL

(75) Inventor: Ronald D. Riker, Brownwood, TX (US)

(73) Assignee: Caminoverde II, L.L.P., Hutto, TX (US)

( * ) Notice: Subject to any disclaimer, the term of this patent is extended or adjusted under 35 U.S.C. 154(b) by 0 days.

(21) Appl. No.: 11/676,338

(22) Filed: Feb. 19, 2007

(65) Prior Publication Data

US 2007/0137080 A1 Jun. 21, 2007

Related U.S. Application Data

(63) Continuation of application No. 10/723,968, filed on Nov. 26, 2003, now Pat. No. 7,179,016.

(51) Int. Cl.
*E01F 9/00* (2006.01)
*E01F 9/011* (2006.01)

(52) U.S. Cl. ..... 404/9; 404/10; 116/63 R

(58) Field of Classification Search ..... 404/9–10; 256/13.1; 116/63 R, 63 P
See application file for complete search history.

(56) References Cited

U.S. PATENT DOCUMENTS

| | | | |
|---|---|---|---|
| 3,669,722 | A | 6/1972 | Bishop |
| 5,010,122 | A | 4/1991 | Koski |
| 5,114,648 | A | 5/1992 | Kuc, Sr. |
| 5,312,573 | A | 5/1994 | Rosenbaum et al. |
| 5,490,742 | A | 2/1996 | Cronk |
| 5,675,956 | A | 10/1997 | Nevin |
| 5,733,943 | A | 3/1998 | Doan |
| 6,322,863 | B1 | 11/2001 | Kubicky |
| 6,367,208 | B1 | 4/2002 | Campbell et al. |
| 6,409,433 | B1 | 6/2002 | Hubbell et al. |
| 6,620,363 | B2 | 9/2003 | Farris et al. |
| 2001/0008322 | A1 | 7/2001 | Rosenbaum |
| 2002/0147255 | A1 | 10/2002 | Kubicky et al. |
| 2003/0072904 | A1 | 4/2003 | Hansen |

*Primary Examiner*—Raymond W Addie
(74) *Attorney, Agent, or Firm*—Storm LLP; Mark D. Perdue

(57) ABSTRACT

A post for supporting a roadway sign comprises a hollow, continuous sleeve formed of thermoplastic resin. The sleeve has an interior surface and a continuous core disposed within the sleeve and generally coextensive with the interior surface of the sleeve. The core is formed at least partially of recycled crumb rubber.

16 Claims, 1 Drawing Sheet

SIGNPOST FORMED OF RECYCLED MATERIAL

CROSS-REFERENCE TO RELATED APPLICATION

This application is a continuation of application Ser. No. 10/723,968 now U.S. Pat. No. 7,179,016, filed on Nov. 26, 2003.

FIELD OF THE INVENTION

The present invention relates to highway or roadway signs and more particularly to the posts used to support such signs.

SUMMARY OF THE PRIOR ART

Thousands of signs are employed adjacent highways and roadways in the United States alone, from speed limit signs to stop signs. Because such signs are placed close to the roadway, they are often struck in roadway accidents, making their construction to be "crashworthy" an issue of some importance. The National Cooperative Highway Research Program has promulgated standards for the safety evaluation of highway features such as signs and sign supports in Report 350. The standards set forth in Report 350 relate to the behavior of highway features when struck by a vehicle. The desired behavior is that the sign or other feature fail in such a way that property damage and personal injury are minimized to the extent possible. Thus, the terms "crashworthiness" and "crashworthy," as used herein, actually mean susceptibility to failure in the event of a crash or collision, rather than resistance to failure. The standards and testing methodologies contained in Report 350 have been adopted by most states. Therefore, the majority of roadside signs and features are made in consideration of, if not in compliance with, the standards of Report 350.

Due to the number of roadway signs employed nation- and world-wide, the material cost of the signs is an issue in addition to their crashworthiness. The majority of the signs and signposts are manufactured of steel and aluminum, which is recyclable, but expensive from both a material and manufacturing cost standpoint. Accordingly, it is desirable to reduce material cost and provide environmental responsibility by employing recycled or recyclable materials in roadway signs.

A need exists, therefore, for roadway signage that is both crashworthy and relatively inexpensive to manufacture, while also being environmentally friendly.

SUMMARY OF THE INVENTION

It is a general object of the present invention to provide a sign post or support for use adjacent roadways that is both crashworthy and relatively inexpensive to manufacture, while also being environmentally friendly.

This and other objects of the present invention are achieved by providing a post comprising a hollow, continuous sleeve formed of thermoplastic resin. The sleeve has an interior surface and a continuous core disposed within the sleeve and generally coextensive with the interior surface of the sleeve. The core is formed at least partially of recycled crumb rubber.

According to the preferred embodiment of the present invention, the sleeve and core are circular in cross-section and the core is hollow.

According to the preferred embodiment of the present invention, the thermoplastic resin is high-density polyethylene.

According to the preferred embodiment of the present invention, the core is formed of at least 10% by weight recycled crumb rubber, the balance being recycled thermoplastic resin.

According to the preferred embodiment of the present invention, the core is formed of at least 20% by weight recycled crumb rubber, the balance being recycled thermoplastic resin.

According to the preferred embodiment of the present invention, the object supported by the post is a highway sign having an area of less than 10 square feet.

According to the preferred embodiment of the present invention, the sleeve and core are co-extruded.

According to the preferred embodiment of the present invention, the post has properties conforming to NCHRP Report 350.

DETAILED DESCRIPTION OF THE INVENTION

Figure 1:
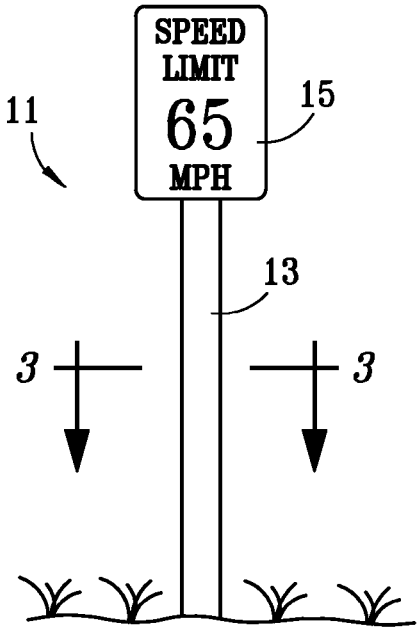
FIG. 1 is an elevation view of a roadway sign, including a sign post or support according to the present invention.
Figure 2:
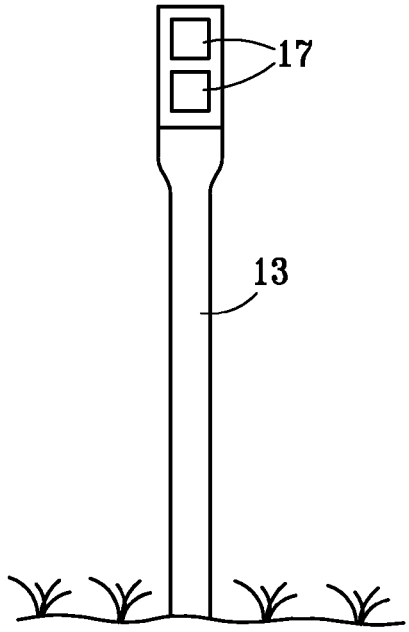
FIG. 2 is an elevation view of a delineator, including a sign post or support according to the present invention.

Referring now to the Figures and particularly to FIGS. 1 and 2, a typical roadway sign 11 is illustrated. Sign 11 includes a post or sign support 13 atop which a sign 15 is mounted. In FIG. 1, sign 15 is a relatively small highway sign, having an area of less than 10 square feet. Post 13 may be sunk into the ground, set in concrete or used with a socket as described in commonly invented application Ser. No. 10/248,743 filed Feb. 11, 2003 and entitled POST MOUNT ASSEMBLY. Typically, these posts are formed of wing-channel or galvanized steel pipe, which is both heavy and ugly. The post 13 according to the present invention, however, provides a seamless, aesthetically pleasing exterior and is relatively light in weight. The post according to the present invention is adapted to support roadway signs up to 10 square feet in area, but can also support smaller objects and signs, and non-sign roadway features such as mailboxes.

FIG. 2 illustrates a sign according the the present invention called a "delineator," because it is used to delineate roadway construction, road hazards, and the like. It also comprises a post 13, as described herein, that is flattened at its upper extent has a plurality of reflectors 17 adhered to the flattened portion, rather than a discrete sign. Typically, delineators are more flexible and resilient than posts that have to support larger signs.

Figure 3:
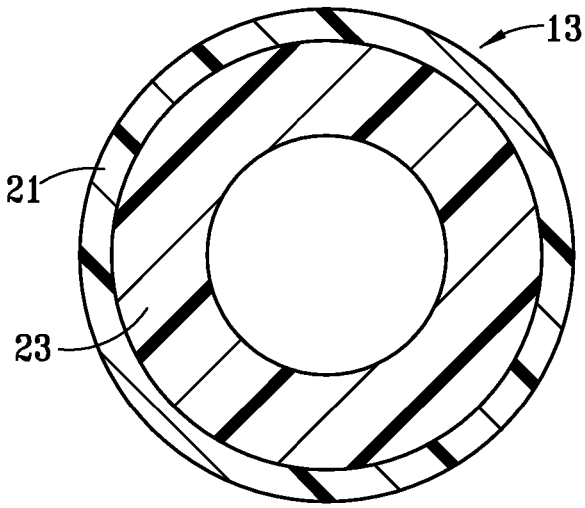
FIG. 3 is a section view, taken along section line 3-3 of FIG. 1, of the post or support according to the present invention.

FIG. 3 is a cross-section view of post 13 according to the present invention, the section being taken along section line 3-3 of FIG. 1. Post 13 comprises an outer sleeve 21 that is preferably formed of virgin high-density polyethylene that presents a smooth exterior that can be made virtually any desired color, although white is preferred for visibility. A core 23 is provided that is coextensive with, and preferably co-extruded with, sleeve 21. According to the present invention, core 21 is formed of a polymeric material comprising at least 10-20% by weight recycled "crumb" rubber, which is usually recycled rubber tires, ground into "crumbs" with steel belting and other detritus removed. Other forms of recycled (usually meaning previously vulcanized) rubber should be suitable for the present invention.

Post 13 is continuous along its length, meaning it has no joints or segments interrupting the geometry, material, and mechanical properties of the post except at its ends, where attachment means may be provided for sign 15 or a socket used to secure the post in the ground. According to the preferred embodiment, this continuous structure is achieved by co-extruding sleeve 21 and core 23. In any case, core 23 is coextensive with the interior of sleeve 21 and provides mechanical strength to post 13.

The dimensions of post 13 may vary depending upon the application. Clearly, the length of post 13 is tailored to the particular sign involved. According to a preferred embodiment of the present invention, which is a post adapted to be a delineator, outer diameter of sleeve 21 is 2.375 inch and the wall thickness of the combined sleeve 21 and core 23 is 0.210-0.250 inch. Because the post is co-extruded, sleeve 21 is non-uniform in thickness and wall thickness can vary between about 0.030 and 0.070 inch. Core 23 may be solid as well, at some cost to material savings. To support a sign of area less than 10 square feet, post 13 has an outer diameter of 2.375 inch and a total wall thickness (sleeve 21 and core 23) of between 0.400 and 0.500 inch.

As stated, core 23 is formed of a polymer containing at least 10-20% by weight recycled crumb (tire) rubber. The percentage of crumb rubber by weight can be varied to increase the stiffness and strength of the resulting polymer. According to the preferred embodiment of the present invention, the core material is made according to the following formula:

25-30% by weight recycled crumb rubber of between 10 mesh and 40 mesh 70-75% high molecular weight, high density polyethylene having a melt index of approximately 0.25.

The polyethylene may be recycled and is a mixture of various melt index polymers to obtain the average melt index of +/−0.25. This mixture is blended in a conventional blender together with 4 to 8 quarts of motor oil per 1000 lb. batch (using lower viscosity motor oil for larger crumb particle size, e.g. for 10 to 25 mesh crumb use 5W30). With a conventional volumetric feeder, the blended material is fed into an extruder where it is continuously extruded, at a temperatures from 380 to 580 degrees Fahrenheit, into pencil-sized strings, which are then cooled in a cooling water bath. and chopped into pellets in a pelletizer.

The pellets then are fed to another extruder and conventionally co-extruded with the polyethylene of sleeve to form sleeve 21, core 23, and post 13 according to the present invention. Thus, the resulting sleeve and core are formed in close conformity with one another, resulting in generally uniform mechanical properties.

The content of crumb rubber can vary between as little as 10% by weight to as much as 40% by weight. The resulting post, given similar dimensions, is more flexible and less rigid with increasing rubber content.

A post or support 13 manufactured as described above is believed to meet the criteria of NCHRP Report 350. Moreover, the post is lightweight, aesthetically pleasing, and environmentally friendly, making use of recycled and recyclable materials.

The invention has been described with reference to preferred embodiments thereof. It is thus not limited, but susceptible to variation and modification without departing from the scope of the invention.

I claim:

1. A delineator post for use adjacent roadways for supporting a reflector, the post comprising:

a hollow, continuous sleeve formed of thermoplastic resin, the sleeve having an interior surface and exterior surface, the exterior surface defining an exterior of the post;

one end of the sleeve being adapted to be received in and supported by a ground surface, and an opposite end of the sleeve extending from the ground and having the reflector secured thereto, wherein a majority of the post extends from the ground surface; and a continuous core disposed within the sleeve and generally coextensive with and secured directly to the interior surface of the sleeve, the core being formed at least partially of recycled crumb rubber, wherein the core and sleeve are continuous and have generally uniform mechanical properties along the post from the one end to the opposite end.

2. The post according to claim 1 wherein the sleeve and core are circular in cross-section and the core is hollow.

3. The post according to claim 1 wherein the polymeric resin is high-density polyethylene.

4. The post according to claim 1 wherein the core is formed of at least 10% by weight recycled crumb rubber, the balance being recycled thermoplastic resin.

5. The post according to claim 1 wherein the core is formed of at least 20% by weight recycled crumb rubber, the balance being recycled thermoplastic resin.

6. The post according to claim 1 wherein the sleeve and core are co-extruded.

7. A post for use adjacent roadways for supporting an object, the post comprising:

a continuous sleeve formed of thermoplastic resin that is circular in cross-section and has a lower end adapted to be received in and supported by a ground surface, an upper end and a majority of the sleeve length extending from the ground surface and adapted to be secured to the object, the sleeve having an interior surface and an exterior surface, the exterior surface defining an exterior of the post; and a continuous hollow core disposed within the sleeve and generally coextensive with and secured directly to the interior surface of the sleeve, the core being formed of a polymer having a composition including a selected quantity of recycled crumb rubber, wherein the sleeve and core are continuous and have generally uniform mechanical properties from the upper end to the lower end.

8. The post according to claim 7 wherein the thermoplastic resin is high-density polyethylene.

9. The post according to claim 7 wherein the polymer contains at least 20% by weight recycled crumb rubber, the balance being recycled thermoplastic resin.

10. The post according to claim 7 wherein the object is a highway sign having an area of less than 10 square feet.

11. The post according to claim 7 wherein the sleeve and core are co-extruded.

12. The post according to claim 9 wherein the sleeve and core are circular in cross-section.

13. A post for use adjacent roadways, the post comprising:

a hollow sleeve formed of high-density polyethylene that is circular in cross-section and has an interior surface and an exterior surface, the exterior surface defining an exterior of the post, the sleeve having a lower end adapted to be received in and supported by a ground surface and an upper end and a majority of the length of the post extending from the ground surface and adapted to be secured to the object;

a core secured directly to the sleeve and generally coextensive with the interior surface of the sleeve, the core being formed of a polymer having a composition including:

a selected quantity of recycled crumb rubber; and the balance a low-melt-index polyethylene;

wherein the sleeve and core are co-extruded together to form a continuous post having generally uniform mechanical properties along its length.

14. The post according to claim 13 wherein the polymer contains at least 20% by weight recycled crumb rubber, the balance being low-melt-index recycled polyethylene.

15. The post according to claim 13 wherein the post supports a highway sign having an area of less than 10 square feet.

16. The post according to claim 13 wherein the sleeve and core are circular in cross-section and the core is hollow.

* * * * *